US009149861B2

(12) United States Patent
Hork et al.

(10) Patent No.: US 9,149,861 B2
(45) Date of Patent: Oct. 6, 2015

(54) ROTARY SWAGE TOOL UNIT WITH EASY ACCESSIBLE TOOL SPACE

(75) Inventors: Martin Hork, Neuss (DE); Vinzenz Mroz, Eisingen (DE); Werner Michi, Oelbronn-Duerr (DE); Rico Warneck, Remchingen (DE)

(73) Assignee: FELSS GmbH, Koenigsbach-Stein (DE)

( * ) Notice: Subject to any disclaimer, the term of this patent is extended or adjusted under 35 U.S.C. 154(b) by 199 days.

(21) Appl. No.: 13/640,078

(22) PCT Filed: Mar. 28, 2011

(86) PCT No.: PCT/EP2011/054696

§ 371 (c)(1),
(2), (4) Date: Nov. 19, 2012

(87) PCT Pub. No.: WO2011/124486

PCT Pub. Date: Oct. 13, 2011

(65) Prior Publication Data

US 2013/0055779 A1 Mar. 7, 2013

(30) Foreign Application Priority Data

Apr. 9, 2010 (DE) ..... 10 2010 014 601

(51) Int. Cl.

| | |
|---|---|
| ***B21J 13/08*** | (2006.01) |
| ***B21J 7/00*** | (2006.01) |
| ***B21J 13/00*** | (2006.01) |
| ***B21J 7/14*** | (2006.01) |
| *B21J 7/16* | (2006.01) |

(52) U.S. Cl.

CPC *B21J 13/08* (2013.01); *B21J 7/145* (2013.01); *B21J 7/16* (2013.01); *B21J 13/00* (2013.01)

(58) Field of Classification Search

CPC ..... B21J 7/16; B21J 13/08; B21J 7/46; B21J 13/00

USPC ..... 72/76, 479, 482.92

See application file for complete search history.

(56) References Cited

U.S. PATENT DOCUMENTS 1,507,621 A * 9/1924 Perry et al. ..... 72/41
1,858,733 A * 5/1932 Flachbart ..... 72/402

(Continued)

FOREIGN PATENT DOCUMENTS

CN 2743060 11/2005
CN 2877919 3/2007
CN 2877919 Y * 3/2007 ..... B21J 5/02

(Continued)

OTHER PUBLICATIONS

Translation of DE 4002855 C1.*

*Primary Examiner* — Peter DungBa Vo
*Assistant Examiner* — John S Lowe
(74) *Attorney, Agent, or Firm* — Michael J. Striker

(57) ABSTRACT

A rotary swaging machine comprises a tool unit having a tool space which receives a plurality of shaping swaging tools. The swaging tools are used for processing a workpiece which can be introduced into the tool space. A front cover locking mechanism of the tool unit includes an actuation device and is provided for locking a front cover of the tool unit in a position in which the front cover at least partially covers the tool space at a tool space side. In order to change swaging tools, the front cover can be unlocked and moved into a position in which the front cover releases the tool space for removal or insertion of swaging tools at the tool space side.

11 Claims, 3 Drawing Sheets

(56) References Cited

U.S. PATENT DOCUMENTS

Figure 1:
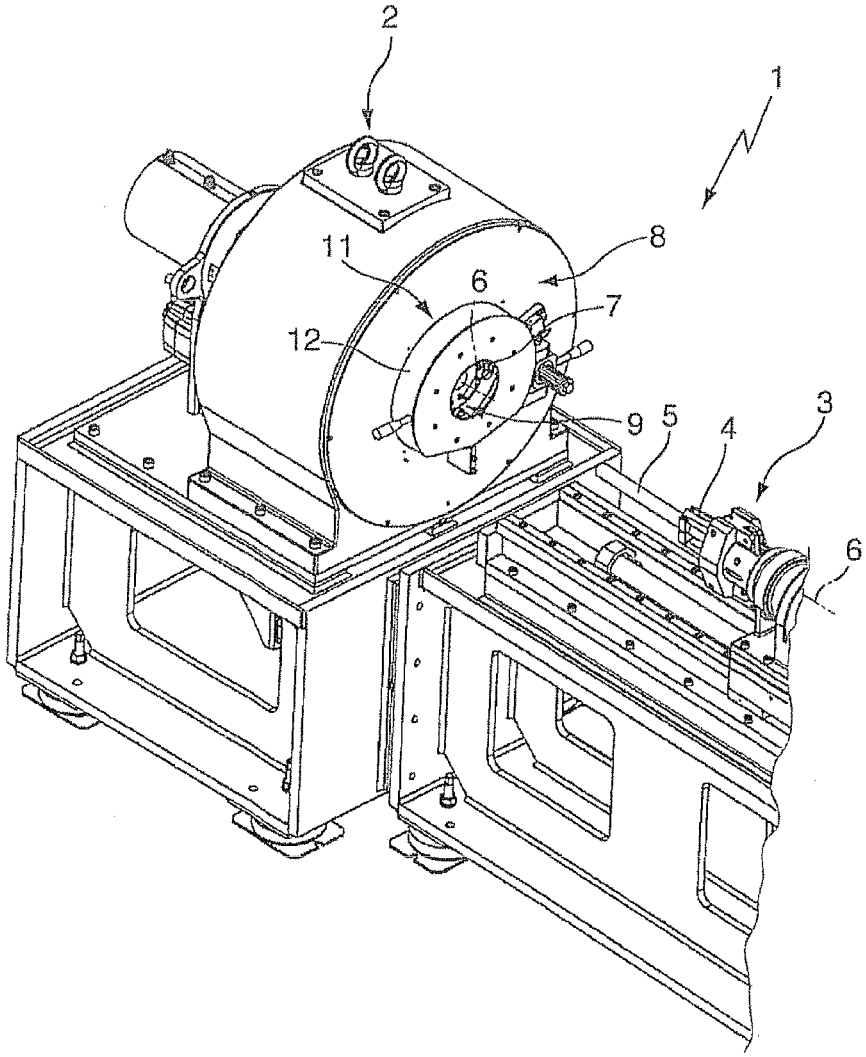

| | | | | |
|---|---|---|---|---|
| 5,036,691 | A * | 8/1991 | Binhack et al. | 72/76 |
| 2013/0055779 | A1 * | 3/2013 | Hork et al. | 72/76 |

FOREIGN PATENT DOCUMENTS

| | | | | |
|---|---|---|---|---|
| CN | 201147816 | | 11/2008 | |
| CN | 201147816 | Y * | 11/2008 | B21J 13/14 |
| DE | 40 02 854 | | 10/1991 | |
| DE | 40 02 855 | | 10/1991 | |
| DE | 4002854 | C1 * | 10/1991 | B21J 7/16 |
| DE | 4002855 | C1 * | 10/1991 | B21J 7/16 |
| DE | 199 55 321 | | 8/2001 | |
| DE | 19955321 | A1 * | 8/2001 | B21J 7/16 |
| EP | 0 411 300 | | 2/1991 | |
| EP | 0411300 | A2 * | 10/1991 | B21J 7/16 |
| EP | 0 476 350 | | 3/1992 | |
| EP | 0476350 | A1 * | 3/1992 | B21J 7/145 |
| GB | 466 090 | | 5/1937 | |
| GB | 466090 | A * | 5/1937 | B21J 7/16 |
| JP | 59 178146 | | 10/1984 | |
| JP | 59178146 | A * | 10/1984 | B21J 7/18 |
| JP | 6-269893 | | 9/1994 | |
| JP | 06269893 | A * | 9/1994 | B21J 7/16 |

* cited by examiner

ROTARY SWAGE TOOL UNIT WITH EASY ACCESSIBLE TOOL SPACE

The invention relates to a tool unit of a rotary swaging machine having a tool space in which there are provided a plurality of shaping swaging tools for processing a workpiece which can be introduced into the tool space, and having a front cover by means of which the tool space can be at least partially covered at a tool space side, the front cover, in order to change shaping swaging tools, being able to be moved into at least one position in which the front cover releases the tool space for removal or insertion of shaping swaging tools at the tool space side.

A rotary swaging machine is generally used to shape, for example, rods or pipes, with the cross-section of at least one longitudinal portion of the workpiece being reduced. To this end, a rotary swaging machine has a tool unit with an operating space in which at least two shaping tools are provided. The shaping tools are constructed in such a manner that they can completely or partially surround the workpiece longitudinal portion to be processed. Using a shaping drive, the shaping tools are moved radially towards the workpiece. Different construction types of shaping drives for rotary swaging machines are known. These include, for example, hydraulic shaping drives or electromotive ring rotor drives.

The shaping tools must be constructed so as to be specifically adapted to various shaping operations. The shaping tools therefore generally have to be changed between different workpiece processing operations.

In conventional rotary swaging machines, changing tools is a relatively complex operation. In order to be able to remove the shaping tools from the tool space and to be able to insert other shaping tools into the tool space, a front cover in the form of a front plate must be removed from a tool space side. The front plate is screwed to a component which surrounds the tool space, generally the so-called jaw guide, by means of a plurality of fixing screws. In order to be able to remove the front plate from the tool space side, an operator must therefore first unscrew the individual fixing screws, for example, using a wrench or the like. This operation is relatively complex and time-consuming.

An object of the invention is to further develop the tool unit of a conventional rotary swaging machine in such a manner that there is produced a tool unit which is distinguished by ease of handling when the shaping swaging tools are changed.

According to the invention, this object is achieved by a tool unit of a rotary swaging machine having the features of claim 1.

According to the invention there is provided a front cover locking mechanism which is provided with an actuation device. Using the front cover locking mechanism, the front cover can be locked in a position in which the front cover at least partially covers the tool space at the tool space side. Owing to the invention, an operator now no longer has to laboriously release, for example, screwing of the front cover using additional tools in order to change the shaping tools. Using the actuation device, he simply has to unlock the front cover locking mechanism and lock it after successfully changing a tool, respectively.

Various configurations of front cover locking mechanisms may be considered. The front cover locking mechanism preferably has one or more locking elements which can be moved by means of the actuation device substantially with a pivoting and/or linear movement between a release position and a locking position. In the locking position, the front cover is secured to the tool space side, for example, with a rear grip being formed between elements at the front cover side and at the tool space side. Locking elements in the form of rods, pins, plates, balls, etc. can be used.

Other advantageous embodiments of the tool unit according to claim 1 will be appreciated from the features of claims 2 to 11.

Preferably, the actuation device of the front cover locking mechanism may have a drive by means of which the front cover locking mechanism can be driven to lock and unlock the front cover. It is possible to mention by way of example hydraulic and pneumatic actuation cylinders by means of which at least one locking element can be moved back and forth between a release position and a locking position. An electrical actuating drive can further be used as a drive.

Alternatively, the actuation device of the front cover locking mechanism is constructed in such a manner that it can be manually activated by an operator. In particular, the actuation device is provided for this purpose with a gripping element, for example, a handle or the like. In order to release and close the front cover locking mechanism, an operator only has to grasp the handle and activate it accordingly. There is produced a compact and cost-effective variant of a front cover locking mechanism, which can be activated without the use of additional tools.

A particularly compact construction of a tool unit according to the invention is produced by the actuation device of the front cover locking mechanism being secured to the front cover. The actuation device and the front cover consequently form a compact front cover unit. At the side of the tool space, it is thus not necessary to accommodate any particular mechanisms for actuating the front cover locking mechanism, etc.

In this context, it is particularly advantageous for a handle for actuating the front cover locking mechanism to be provided on the front cover and in particular not to be secured to components at the side of the tool space.

In the case of the tool unit according to the invention, the front cover is provided in particular with a passage for introducing a workpiece portion to be processed into the tool space. Furthermore, the front cover can be provided with other through-openings through which, for example, adjustment wedges for adjusting the stroke position of the shaping swaging tools can protrude over the tool space side. Preferably, there is provided on the front cover a covering hood which surrounds the adjustment wedges and above which a handle for actuating the front cover locking mechanism protrudes.

In a particularly advantageous configuration of the invention, the locking element of the front cover locking mechanism is movably supported on the front cover in order to lock and unlock the front cover. This also results in a compact front cover unit comprising the front cover and the front cover locking mechanism. Additional locking mechanisms or the like at the side of the components surrounding the tool space can substantially be dispensed with.

Preferably, the front cover locking mechanism has a locking element which is pivotably or rotatably supported for locking and unlocking the front cover. It is particularly space-saving for the locking element to be pivotably supported about a pivot axis which extends perpendicularly relative to the tool space side, that is to say, in particular perpendicularly relative to the plane of the front cover.

Another configuration of a tool unit according to the invention is distinguished by particularly pleasant handling. In this instance, the front cover is supported so as to be able to be displaced relative to the tool space side by means of a front cover guide. The operator does not have to carry the front cover when removing the front cover from the tool space side. Instead, the front cover is supported on the front cover guide and can simply be pushed away from the tool space side. The transfer movement of the front cover relative to the workpiece space side additionally has the advantage that, in the case of a front cover, through which, for example, adjustment wedges protrude from the workpiece space over the workpiece space side, the front cover can also at the same time be removed from the adjustment wedges owing to the transfer movement.

Advantageously, the front cover can also be pivotably supported with respect to the tool space side by means of a front cover pivot bearing. It is particularly advantageous for the pivot axis of the front cover pivot bearing to extend parallel with the plane of the tool space side. The front cover can be pivoted away from the tool space side in the manner of a flap. Again, the operator preferably does not have to carry the front cover during removal from the tool space side.

Particularly pleasant handling is achieved when the front cover can be driven by means of a drive or drives during the transfer movement and/or the pivot movement. For example, it is possible to use hydraulic, pneumatic, electrical actuating drives, etc.

In a particularly preferred embodiment, the front cover is both movably supported relative to the tool space side by means of a front cover guide and at the same time pivotably supported relative to the tool space side by means of a front cover pivot bearing. Owing to the displacement movement along the front cover guide, the front cover can first be removed, for example, from the protruding adjustment wedges. The front cover can subsequently be pivoted to the side in an unimpeded manner in order to allow free access to the tool space.

The above-mentioned bearing and guiding of the front cover during removal from the tool space side is particularly advantageous in a tool unit in which the shaping tools move into abutment against the front cover during the workpiece processing operation. For example, owing to adjustment wedges or the like, the shaping tools are axially pressed in this case with relatively high forces against the front cover. Consequently, the front cover must be constructed so as to be extremely stable and consequently also heavy. Owing to the guide or the bearing of the front cover, the relatively heavy front cover does not have to be carried by the operator.

In order to prevent the front cover locking mechanism from becoming detached, for example, owing to vibrations during the workpiece processing operation, the front cover locking mechanism can be clamped in a locking position by means of a clamping device. For example, the front cover locking mechanism can be tensioned or clamped in the manner of a bayonet closure (automatically) during locking. A disadvantage of this variant is that a front cover locking mechanism of this type is relatively difficult to operate.

A particularly preferred configuration of the invention, in which the front cover locking mechanism has an independently actuatable clamping device in order to secure the front cover locking mechanism in a locking position, is characterised by a high level of operational safety, and at the same time smooth actuation of the front cover locking mechanism. The clamping device preferably has driven clamping means, for example, hydraulic clamping cylinders. The clamping force does not have to be applied by the operator in this instance. The operator can, for example, operate the clamping device by activating a switch element or the like after successful locking.

A configuration of the invention which is particularly robust and which has been found to be advantageous in practice is produced by the front cover locking mechanism having at least one pin which is secured to a component which surrounds the tool space, in particular the so-called jaw guide. The pin constitutes a particularly robust securing or locking element. The pin is arranged in such a manner that it protrudes through a through-opening on the front cover when it at least partially covers the tool space at the tool space side.

Furthermore, the front cover locking device has, in the case of the preferred configuration of the invention, a locking plate which also has at least one through-opening, through which the pin head can protrude. The locking plate can be moved relative to the pin between a release position and a locking position. In the locking position, the locking plate engages behind the protruding pin head.

In a particularly compact configuration of the invention, the locking plate and the front cover are constructed in an integral manner. In this variant, the front cover itself is pivoted or rotated in order to be locked or unlocked. Alternatively, however, the locking plate is supported as a separate component on the front cover so as to be able to be moved between the release position and the locking position. Advantageously, the front cover itself does not have to be constructed in a rotatable or pivotable manner in this instance.

Figure 2:
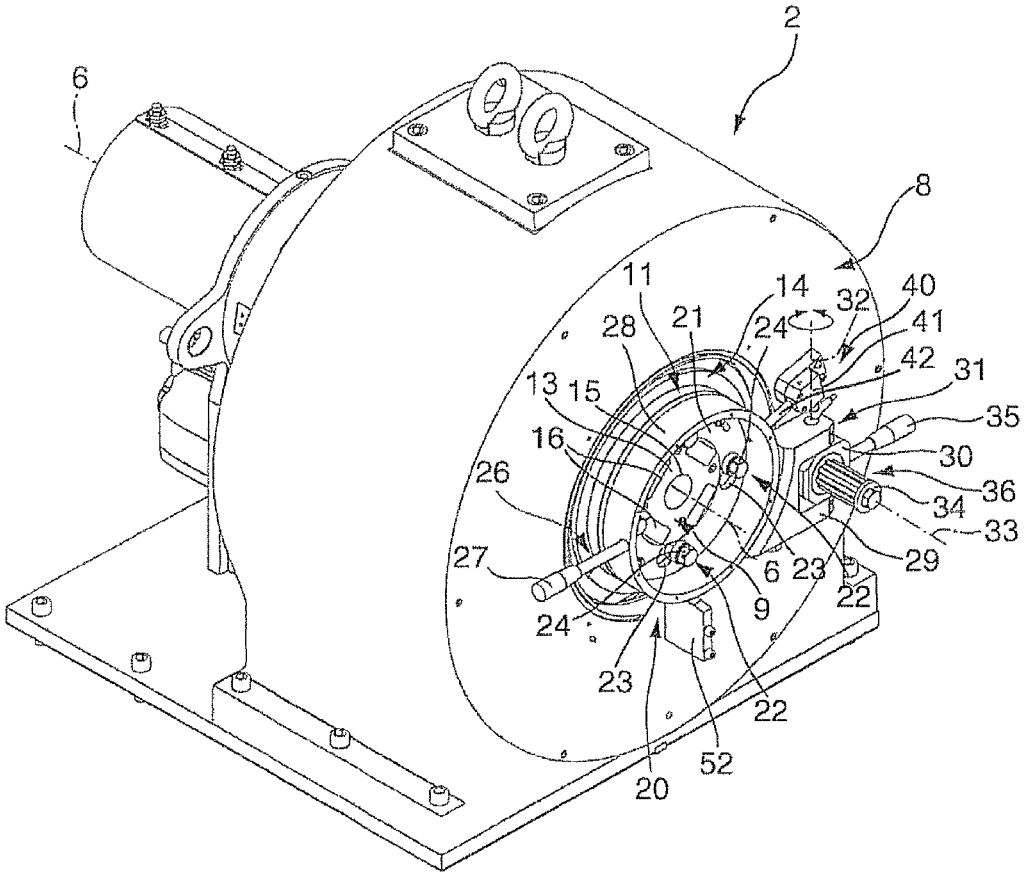
Figure 3:
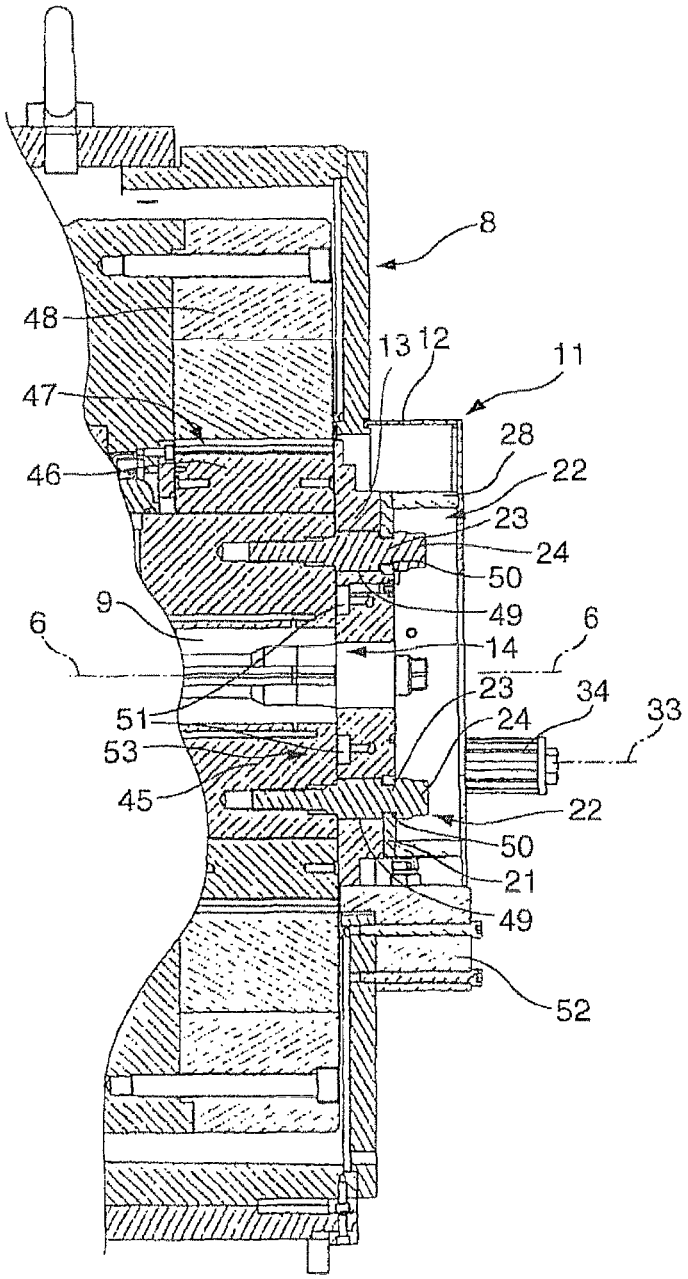

The invention is explained in greater detail below with reference to exemplary schematic illustrations, in which:

FIG. 1: is a perspective view of a rotary swaging machine,

FIG. 2: is a tool unit of the rotary swaging machine from FIG. 1, a covering hood being removed, and FIG. 3: is a sectioned view of part of the tool unit.

FIG. 1 illustrates a rotary swaging machine 1 having a tool unit 2 and a workpiece feed unit 3 which is only partially illustrated. Using the workpiece feed unit 3, a workpiece 5 which is clamped to a collet chuck 4, for example, a pipe, can be conveyed along an insertion axis 6 or operating axis of the tool unit 2. The insertion axis 6 coincides with a longitudinal axis of the clamped workpiece 5. Via an introduction opening 7 at a front side 8 of the tool unit 2, the clamped workpiece 5 can be introduced with a workpiece longitudinal portion to be processed into a tool space 9 of the tool unit 2.

In FIG. 2, the tool unit 2 of the rotary swaging machine 1 is shown alone. The tool unit 2 has a front cover unit 11, a covering hood 12 of the front cover unit 11 shown in FIG. 1 not being illustrated so that components of the front cover unit 11 which are arranged therebelow can be seen better.

The front cover unit 11 has a front cover which is constructed as a circular front plate 13. The front plate 13 at least partially covers the tool space 9 of a tool space side 14. It has a circular passage 15 for introducing a workpiece 5 into the tool space 9. The front plate 13 is further provided with additional elongate through-openings 16 through which adjustment wedges (not illustrated) can protrude from the tool space 9 through the front plate 13.

There is further provided a front cover locking mechanism 20 by means of which the front plate 13 can be locked in the position illustrated. The front cover locking mechanism 20 has a locking element in the form of an annular locking plate 21. The locking plate 21 rests flat at the side of the front plate 13 remote from the tool space 9. For the locking operation, it co-operates with four locking pins 22. The locking pins 22 protrude through keyhole-like recesses 23 of the locking plate 21. The keyhole-like recesses 23 each have a portion with a diameter which corresponds at least to the largest diameter of the pin heads 24. Furthermore, they each have a portion with a clearly smaller diameter. Owing to the locking pins 22 which protrude through the keyhole-like recesses 23, the locking plate 21 is supported on the front plate 13 so as to be able to be pivoted about the insertion axis 6.

An actuation device 26 of the front cover locking mechanism 20 has a handle in the form of an actuation lever 27. The actuation lever 27 is secured to a support ring 28 which in turn is securely connected to the locking plate 21.

The front plate 13 is secured to a c-shaped carrier arm 29. The carrier arm 29 engages round a sliding bearing 30 and is connected thereto by means of a pivot bearing 31 so as to pivot about a pivot axis 32. The pivot axis 32 extends parallel with the plane of the tool space side 14 which is covered by the front plate 13 or parallel with the plane of the front plate 13.

The sliding bearing 30 is arranged so as to be able to be displaced along a displacement axis 33 on a guiding rod 34 which extends through the sliding bearing 30 and which is secured to the front side 8 of the tool unit 2. The displacement axis 33 extends perpendicularly relative to the plane of the tool space side 14 which is covered by the front plate 13 or perpendicularly relative to the plane of the front plate 13. The sliding bearing 30 is provided with an additional handle in the form of a hand lever 35. The sliding bearing 30 and the guiding rod 34 form a front cover guide 36 for the front plate 13.

An interrogation device 40 for locking interrogation is also secured to the front side 8 of the tool unit 2. The interrogation device 40 has a switching sensor 41 and a switching lever 42. The switching lever 42 is secured to the support ring 28. Its position is therefore determined by the rotational position of the support ring 28 about the insertion axis 6. In the illustrated rotational position of the support ring 28 (locking position), the switching lever 42 contacts the switching sensor 41. In this manner, it is possible to verify whether the front cover locking mechanism 20 is locked.

FIG. 3 illustrates a portion of the tool unit 2 in a sectioned view along a vertical plane of section, in which the insertion axis 6 extends.

According to FIG. 3, the tool space 9 is surrounded by a jaw guide 45 on which the shaping tools are supported so as to be able to be radially displaced. Using adjustment wedges which can be displaced along the insertion axis 6, the radial stroke position of the shaping tools can be adjusted. The shaping tools move into abutment against the front plate 13 during the workpiece processing operation and act upon it with considerable axial forces owing to the redirection of the radial shaping force by the adjustment wedges. However, both shaping tools and the adjustment wedges are not illustrated in FIG. 3.

The drive for the shaping tools is constructed as a conventional ring rotor drive. A roller cage 47 which is provided with pressing rollers 46 surrounds the jaw guide 45 centrally around the insertion axis 6. The roller cage 47 is in turn surrounded by a motor-driven external rotor ring 48. The insertion axis 6 consequently also forms an operational axis of the tool unit 2.

According to FIG. 3, the locking pins 22 are screwed into the jaw guide 45. They protrude through cylindrical recesses 49 of the front plate 13 through the front plate 13. The pin heads 24 are undercut with a continuous groove 50. In the illustrated position of the locking plate 21, the pin heads 24 which are undercut with the continuous groove 50 are arranged in the portion of the keyhole-like recesses 23 on the locking plate 21 which has the smaller diameter, that is to say, precisely a diameter which corresponds to the diameter of the locking pins 22 in the region of the continuous groove 50. The locking plate 21 consequently engages behind the pin heads 24. Owing to the rear grip of the locking plate 21, the front plate 13 which abuts the locking plate 21 in a planar manner cannot be removed in this position of the locking plate 21 from the tool space side 14 in the direction of the insertion axis 6 (in FIG. 3 to the left). The locking plate 21 consequently assumes a locking position.

There are further provided at the side of the front plate 13 facing the tool space 9 four hydraulically operated clamping cylinders 51 which are distributed evenly about the insertion axis 6. Two of the clamping cylinders 51 are illustrated in FIG. 3. The clamping cylinders 51 are part of the clamping device 53 for securing the front cover locking mechanism 20. When the clamping cylinders 51 are activated, they press the front plate 13 away from the jaw guide 45. The locking plate 21 is thereby pressed at the same time onto the undercut pin heads 24. The locking plate 21 is thereby prevented from becoming disengaged in the locking position.

The activation and deactivation of the clamping cylinders 51 are carried out by means of a switch valve (not illustrated). Alternatively, the clamping cylinders 51 could also be arranged, for example, in such a manner that they press the locking plate 21 away from the front plate 13 onto the pin heads 21.

There is further provided below the front cover unit 11 at the front side 8 of the tool unit 2 a support plate 52 for securing a cooling lubricant return pipe (not illustrated).

A sequence of a tool change on the tool unit 2 will be described below by way of example based on the relationships illustrated in the Figures. According to FIGS. 1 to 3, the locking plate 21 is arranged in a locking position and secured in this position by means of the clamping device 53. In order to be able to remove the front plate 13 from the tool space side 14, an operator must first deactivate the clamping cylinders 51 by activating the switch valve (not illustrated). In order to release the front cover locking mechanism 20, the lef operating lever 27 can now be moved downwards by an operator in FIG. 2. This brings about a pivoting movement of the locking plate 21 about the insertion axis 6. The undercut pin heads 24 are now arranged in the keyhole-like recesses 23 in the portions which have a diameter which corresponds to the diameter of the pin heads 24. The locking plate 21 is arranged in a release position. The front plate 13 is consequently unlocked.

An operator can now grip both hand levers 27, 35 of the front cover unit 11 and move the entire front cover unit 11 forwards along the guiding rod 34, that is to say, away from the tool space side 14. The locking pins 22 extend from the recesses 49 of the front plate 13. At the same time, the front cover unit 11 can be removed by this linear movement from adjustment wedges which protrude through the through-openings 16 over the front plate 13.

After the front plate 13 has been removed from the tool space side 14 by the linear movement, an operator can pivot the front cover unit 11 about the pivot axis 32. The tool space 9 is now released for a tool change. Furthermore, by removing the front plate 13, the adjustment wedges, so-called base jaws, the pressing rollers 46 of the roller cage 47, etc., are released for a change or maintenance operations.

Following a successful tool change, the front cover unit 11 is again positioned at the tool space side 14 in reverse order and locked thereto. The locking state of the front cover locking mechanism 2Q is interrogated by means of the interrogation device 40 and the clamping device 53 of the front cover locking mechanism 20 is finally activated.

The invention claimed is:

1. A tool unit of a rotary swaging machine (1), comprising:

a tool space (9);

a plurality of shaping swaging tools for processing a workpiece (5) introduced into the tool space (9), a front cover (13) by which the tool space (9) is at least partially covered at a tool space side (14), the front cover (13), in order to change shaping swaging tools, moveable into at least one position in which the front cover (13) releases the tool space (9) for removal or insertion of shaping swaging tools at the tool space side (14), a front cover locking mechanism (20) provided with an actuation device (26) by which the front cover (13) is locked in a locked position to at least partially cover the tool space (9) at the tool space side (14) and by which the front cover (13) is unlocked to move into the at least one position in which the front cover (13) releases the tool space (9), a front cover guide (36) configured to support the front cover (13) such that the unlocked front cover (13) is longitudinally displaceable along the front cover guide (36) along a displacement axis (33) away from the tool space side (14) or towards the tool space side (14), and a front cover pivot bearing (31) configured to support the front cover (13) such that the unlocked front cover (13) is pivotably hinged with respect to the tool space side (14) about a pivot axis (32) that extends parallel with the plane of the tool space and is perpendicular to said displacement axis (33) and an insertion axis (6).

2. The tool unit according to claim 1, wherein the actuation device (26) of the front cover locking mechanism (20) comprises a drive for driving the front cover locking mechanism (20) to lock and unlock the front cover (13).

3. The tool unit according to claim 1, wherein the front cover locking mechanism (20) can be manually activated by an operator using the actuation device (26) of the front cover locking mechanism (20).

4. The tool unit according to claim 1, wherein the actuation device (26) of the front cover locking mechanism (20) is secured to the front cover (13).

5. The tool unit according to claim 1, wherein the actuation device (26) of the front cover locking mechanism (20) comprises a handle (27) which is provided on the front cover (13).

6. The tool unit according to claim 1, wherein the front cover locking mechanism (20) comprises a locking element (21) which is movably supported on the front cover (13) in order to lock and unlock the front cover (13).

7. The tool unit according to claim 1, wherein the front cover locking mechanism (20) comprises a locking element (21) which is pivotably supported for locking and unlocking the front cover (13).

8. The tool unit according to claim 1, comprising a drive for driving the front cover (13) along the front cover guide (36) towards or away from the tool space side (14).

9. The tool unit according to claim 1, comprising a drive for driving the front cover (13) to pivot with respect to the tool space side (14) about the pivot axis (32), which extends parallel with the plane of the tool space side (14).

10. The tool unit according to claim 1, wherein the front cover locking mechanism (20) comprises a clamping device (53) in order to secure the front cover locking mechanism (20) in a locking position.

11. The tool unit according to claim 1, wherein the front cover locking mechanism (20) comprises:

at least one pin (22) secured to a component (45) which surrounds the tool space (9) such that the pin (22) protrudes over the front cover (13) with an undercut pin head (24) when the front cover (13) at least partially covers the tool space (9) at the tool space side (14), and a locking plate (21) with at least one through-opening (23), through which the pin head (24) can protrude, wherein the locking plate (21), in order to lock the front cover (13), is moved relative to the pin (22) into a locking position in which the locking plate (21) engages behind the pin head (24) which protrudes through the through-opening (23).

* * * * *